US007572177B2

(12) United States Patent
Maki

(10) Patent No.: US 7,572,177 B2
(45) Date of Patent: Aug. 11, 2009

(54) ADJUSTABLE APPARATUS FOR DISPENSING DISC SHAPED OBJECTS

(75) Inventor: Tadanori Maki, Osaka (JP)

(73) Assignee: Himecs Co., Ltd., Osaka-shi (JP)

( * ) Notice: Subject to any disclaimer, the term of this patent is extended or adjusted under 35 U.S.C. 154(b) by 40 days.

(21) Appl. No.: 11/806,200

(22) Filed: May 30, 2007

(65) Prior Publication Data

US 2008/0220708 A1 Sep. 11, 2008

(30) Foreign Application Priority Data

Mar. 6, 2007 (JP) ..... 2007-055999

(51) Int. Cl.
*G07D 1/00* (2006.01)

(52) U.S. Cl. ..... 453/18

(58) Field of Classification Search ..... 453/18; 221/287

See application file for complete search history.

(56) References Cited

U.S. PATENT DOCUMENTS 1,811,503 A * 6/1931 Janovsky et al. ..... 453/35
5,074,434 A 12/1991 Maki
5,232,398 A 8/1993 Maki
5,435,777 A * 7/1995 Takatani et al. ..... 453/31
6,336,544 B1 * 1/2002 Blad et al. ..... 194/217
6,484,884 B1 * 11/2002 Gerrity et al. ..... 209/233
7,270,599 B2 * 9/2007 Hu et al. ..... 453/18
7,294,051 B2 * 11/2007 Bell ..... 453/49
7,377,847 B2 * 5/2008 Irie ..... 453/18
2002/0013127 A1 * 1/2002 Abe et al. ..... 453/18
2004/0176020 A1 * 9/2004 Abe ..... 453/49

* cited by examiner

*Primary Examiner*—Patrick Mackey
*Assistant Examiner*—Mark Beauchaine
(74) *Attorney, Agent, or Firm*—Pillsbury Winthrop Shaw Pittman, LLP

(57) ABSTRACT

In a device for dispensing disc shaped objects having a rotating member for moving the disc shaped objects in an annular path, a guide module is constructed to support guide elements that extend into the annular path to urge the disc shaped objects towards the exit of the dispenser. The guide module is mounted on the dispenser for movement to enable adjustment of the position of the guide elements within the annular path to accommodate differently sized disc shaped objects.

20 Claims, 8 Drawing Sheets

ADJUSTABLE APPARATUS FOR DISPENSING DISC SHAPED OBJECTS

CROSS REFERENCE TO RELATED APPLICATIONS

This application claims the benefit of priority of Japanese Patent Application No. 2007-055999, filed Mar. 6, 2007, the entire contents of which are incorporated herein by reference.

BACKGROUND OF THE INVENTION

1. Field of the Invention

This application relates to the field of dispensers for disc shaped objects such as coins, tokens, and the like. In particular the application relates to a device for receiving the disc shaped objects from a hopper, carrying them in a predetermined path, and dispensing the disc shaped objects, where certain elements are adjustable to provide more universal application.

2. Brief Description of Related Developments

Prior art devices of the type involved in this application are described in U.S. Pat. Nos. 5,074,434 and 5,232,398, which issued to an inventor common to this application. The disclosures of these patents are incorporated herein by reference. The U.S. Pat. No. 5,074,434 patent in particular describes a dispensing device that utilizes a disc mounted for rotation about an axis. The disc is positioned at the exit of a bin or hopper in which is collected a supply of the disc shaped objects. The rotatable disc is constructed with a series of openings or cutouts having the dimensions of the objects to be dispensed.

In general the dispensing device of this application may be arranged immediately below the exit of the coin bin so that coins exiting the bin will fall into the cutouts of the rotatable disc or rotor, where they are partially supported by a ring located on the rotor beneath the cutouts. The ring supports the coins on the rotor immediately below the rotor cutouts. Rotation of the rotor causes the coins to move in an annular path towards an exit of the dispenser. As the coins move they encounter guide elements that urge the coins off of the ring, and radially outward towards the exit of the dispenser mechanism.

In its most common application, the device of this application is used with coins, tokens, and other similar objects having dimensions, i.e. thickness and diameter, that vary from item to item, for example, by denomination in the case of coins. Alterations must therefore be made to each dispensing mechanism to accommodate the differing sizes. Considering the coin dispensing application, coins or tokens in common use would have a range of 0.6 to 1.2 inches in diameter and 0.05 to 0.10 inches in thickness. Attempts have been made to achieve a universal usability within these ranges, but with only limited useful results. Generally the more universal the device, the more performance and reliability are sacrificed.

With the introduction of the prior art rotor/hopper mechanism, as described in the above reference patents, a reliable and robust dispenser was achieved, but at the expense of standardization. In these designs the rotor configuration, guide elements, and associated ejection mechanisms must be constructed to closely match the dimensions of the coin, etc. being dispensed.

In particular these mechanisms, as shown in FIG. 1, are constructed having rotors that are suitable for receiving a specific size coin and guide elements that are fixed in positions matched to the size of the coin for which it is to be used.

This causes a significant inconvenience and expense in both manufacture and assembly of the devices.

SUMMARY OF THE INVENTION

It is a purpose of the device of this invention to provide a mechanism of the type described above that is adjustable to dispense disc shaped objects of varied size without exchanging parts or assembling in alternate positions, while using selective installation of interchangeable rotors having differently sized cutouts. To facilitate set up of a dispenser for a particular coin, a bin is constructed having an interface with the dispensing device that provides a tool free accessibility to the dispenser mechanism.

In one embodiment, the device is constructed with a series of removable rotors in which the openings or cutouts are designed to accommodate a specific size coin, for example, one denomination of coin. In addition the guide elements are mounted together on a moveable module in a fixed relative position. The module is mounted for movement on a deck so that the guide elements may be adjustably positioned within the annular path of the coin to accommodate different sizes of objects, tokens, and coins. Therefore, movement of the module allow adjustment of each position of the guide elements to match the size of the coin to which the rotor is adapted.

In another aspect of the device, guide elements are mounted together on a module in a fixed relative position and the module is mounted for movement so that the guide elements may be adjustably positioned within the annular path of the coin to accommodate different sizes of objects, tokens, and coins.

In another aspect of the device, the module for the guide elements is constructed as a sector shaped element, rotatable about the axis of the rotor and extending radially outward into the annular path of the coins. In this instance, the adjustment movement of the guide elements will be a rotation of the module through an angle selected to accommodate the varying sizes of coin.

In another aspect of the invention the adjustment is made with reference to gauge marks imbedded in the structure of the device or with a gauge tool or fixture to measure the displacement of the adjustable guide element module.

In another aspect of the invention, the dispenser mechanism, including rotor and guided path, is constructed on a removable deck that may be fitted to different bases according to the construction of a host device with which the dispenser is used.

In another aspect of the invention, a bin is designed to facilitate access to the dispenser device for adjustment, replacement of rotors, and other maintenance chores. In order to accomplish this, a series of latch mechanisms are constructed to releasably attach the bin to the dispenser device. This allows the coin bin to be detached from the dispensing mechanism without tools to permit rotor replacement and guide element adjustment.

BRIEF DESCRIPTION OF THE DRAWINGS

The dispensing mechanism of this invention is explained in more detail below with reference to the accompanying drawing, in which.

DESCRIPTION OF THE PREFERRED EMBODIMENT

Figure 1:
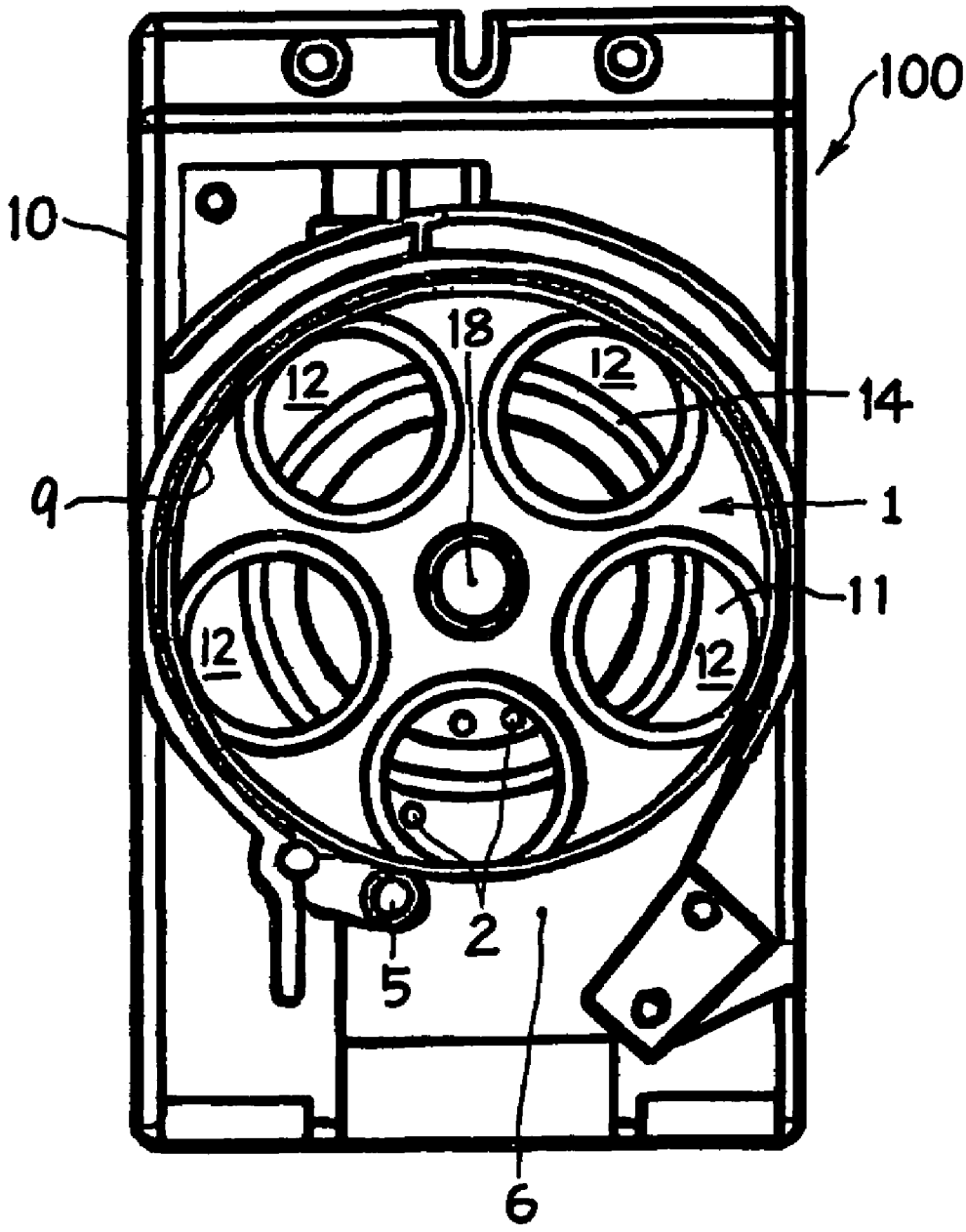
Fig. 1 Prior Art
FIG. 1 is a top view of a dispensing device showing the basic elements of the rotor/hopper style dispensing mechanism of the prior art.

An embodiment of a device for dispensing coins, tokens, and other disc shaped objects, incorporating the features of this invention, is illustrated in the figures. Although the present invention will be described with reference to the embodiments shown in the drawings, it should be understood that the present invention may have many alternate forms. In addition, any suitable size, shape or type of elements or materials could be used. For ease of description and without intending to limit the scope of this application, the disc shaped objects will be referred to as coins or tokens and the embodiments described herein will, in general, be adapted to dispense coins, although it is intended that the device could be used to dispense any disc shaped object.

The features of this invention are generally useful with devices having the basic construction typical of the prior art, as exemplified in the above referenced U.S. Pat. Nos. 5,232,398 and 5,074,434. These elements are shown in FIG. 1 and consist of a base 10 on which is mounted a rotatable disc 1. Disc 1 is mounted on a post 18 for rotation. The disc 1 is driven by a motor (not shown) connected to the disc 1 by a gear or other suitable transmission interface. Disc 1 is easily removable and is positioned in a cylindrical recess 9 formed in base 10. Recess 9 forms the outer boundaries of an annular coin path 11, as shown schematically in FIG. 4.

Disc 1 is constructed with multiple openings or cutouts 12 sized for a specific coin denomination and a support ring 14 constructed immediately below the cutouts to retain the coins as they move in annular path 11. A clearance is constructed between the bottom surface of the disc 1 and the support ring 14 sufficient to allow a coin to be urged from the support ring towards exit 6 of the recess 9. Guide elements, for example, pins 2 and exit roller 5 are fixed in the base 10 in the path 11 of the coins (see FIG. 4). Guide pins 2 may be spring loaded outward to engage the coins and urge the coins off support ring 14 towards exit 6. Exit roller 5 may be biased in the lateral direction into exit 6 by a spring 23 to provide a final guide to a coin as the coin exits the dispenser. Roller 5 may also be adapted to trigger a counter and sense coins as they exit.

In prior art devices, a set of rotors and dispenser bases is needed to accommodate a series of coins in the currency system for which the dispenser is to be used. In the system of this invention, only the exchange of rotors is needed to adapt a base to the coinage. The bases 10 with the dispensing mechanism of this invention have a common construction for all applications.

Figure 2:
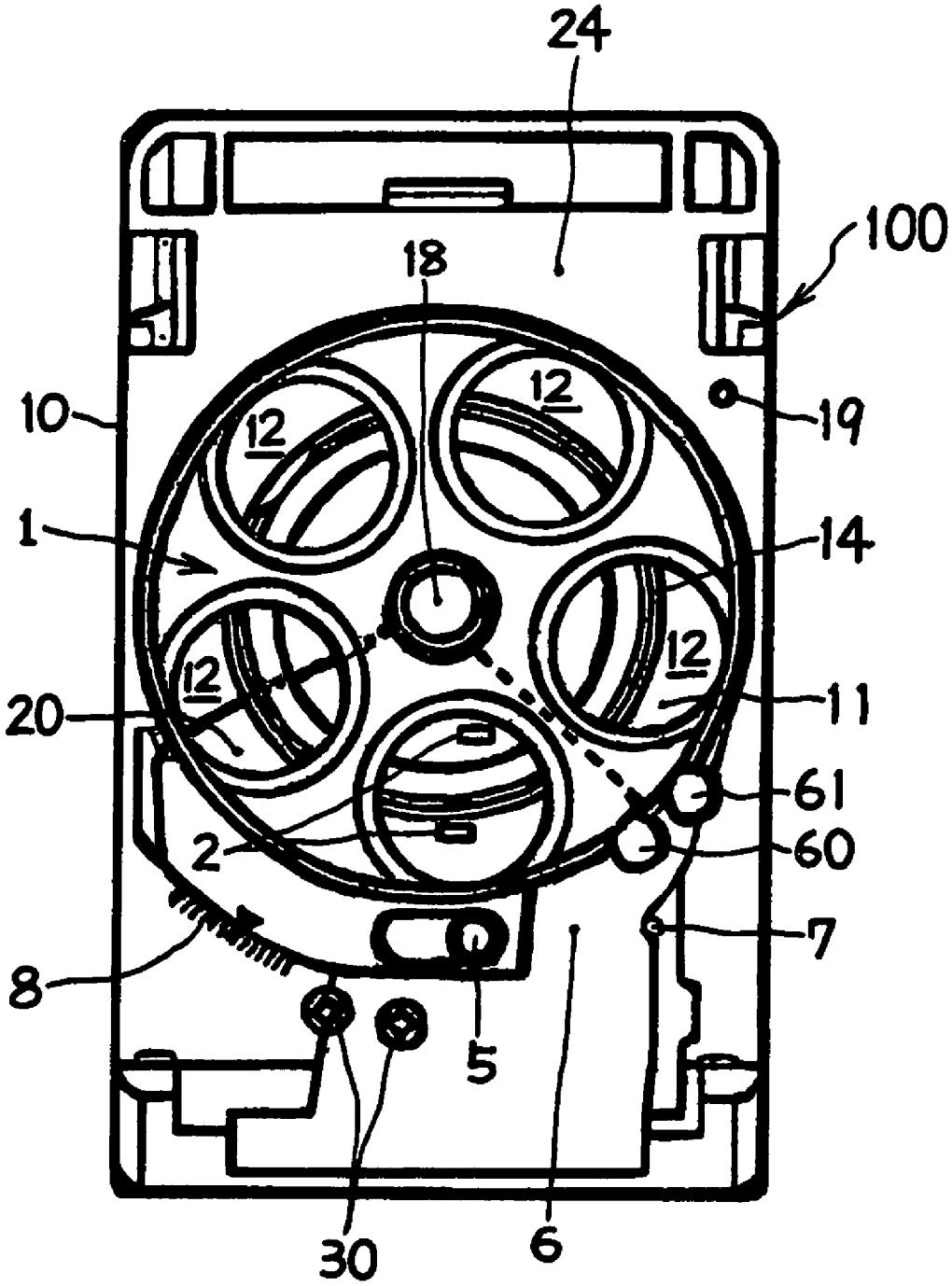
FIG. 2 is a top view of the dispensing device of the subject invention.
Figure 3:
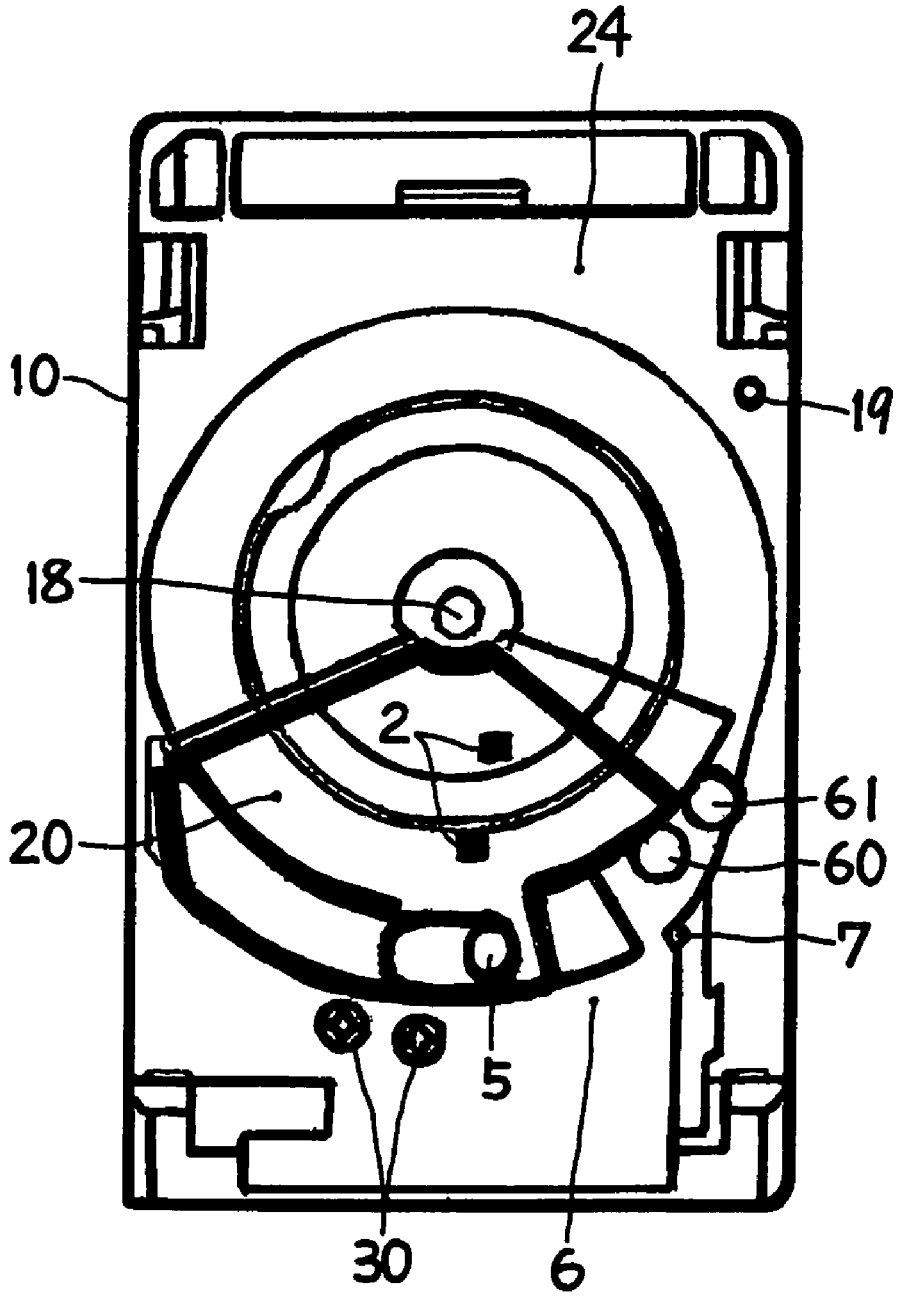
FIG. 3 is top view of the device of FIG. 2, with the rotor removed.
Figure 4:
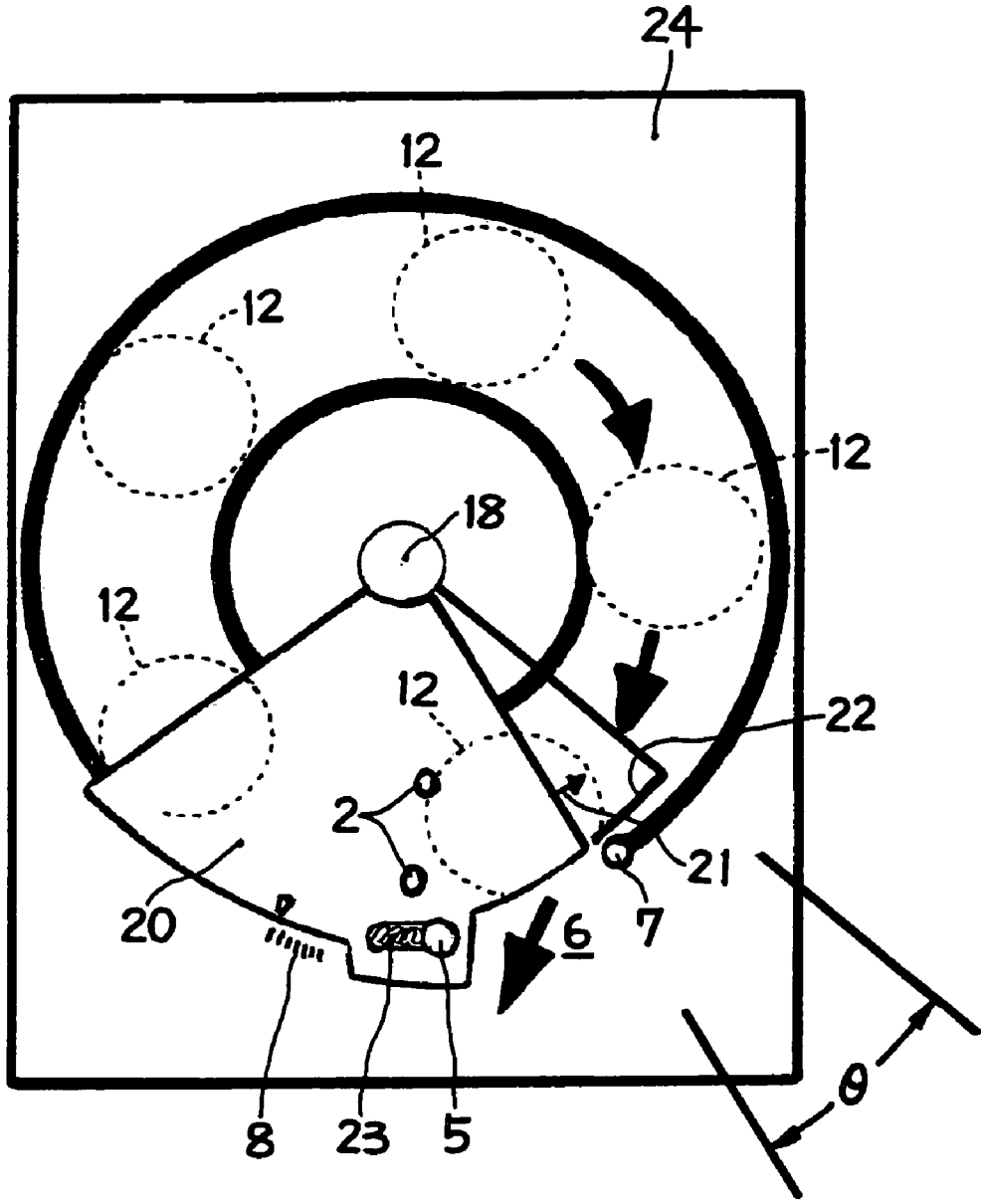
FIG. 4 is a top view of the dispensing device as shown in FIG. 3 enlarged and schematically arranged.

An embodiment of the coin dispensing device of this invention is illustrated in FIGS. 2, 3 and 4 where like reference numerals are used to identify like parts. A guide element module 20 is constructed in the general shape of a sector and is mounted for rotation about the axis of post 18. Other shapes maybe used depending on the configuration of the base and other components. Guide elements 2, 5 are fixed onto module 20 for movement with the module, within the path 11 of the coins. Locking screws 30 may used to lock the module 20 in its selected position during use. Although locking screws 30 are shown, any convenient locking mechanism could be used.

As shown, the module 20 is designed for manual adjustment using reference points or calibration markings 8. The calibration markings 8 may be constructed on a deck 24 to indicate the positions for various denominations or other reference depending on the coins, tokens, or other disc shaped objects for which the dispenser is to be used. The calibration markings 8 may be indicative of difference size disc shaped objects. The position of the guide elements 2 and 5 may be adjusted by rotating module 20 in the direction of arrow 21 through all or part of a range shown by angle θ. A more precision adjustment could be incorporated in the form of an adjustment screw or the like that would be mounted on a deck 24 and engage the module 20. A recessed portion 22 may be constructed in deck 24 to accommodate guide element module 20 and restrain excess movement.

Figure 8:
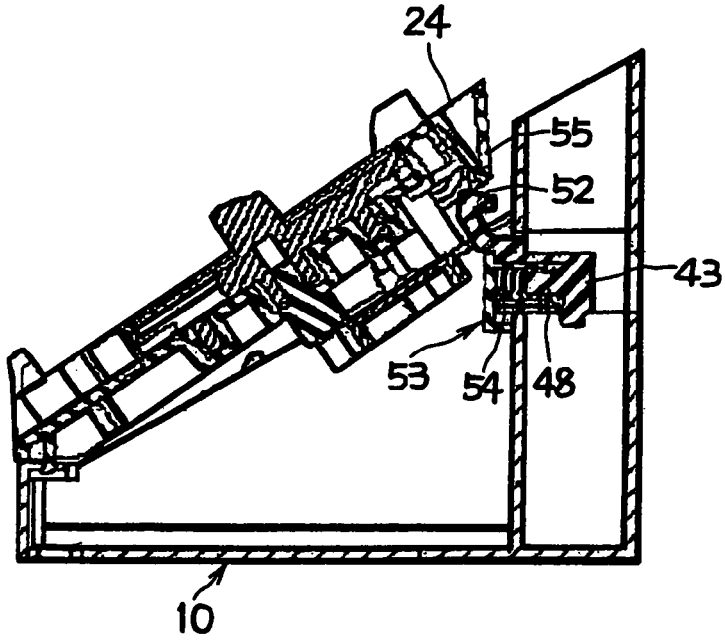
FIG. 8 is a side sectional view of the coin dispenser of FIG. 5, showing the latch mechanism between the deck and base unlatched.
Figure 9:
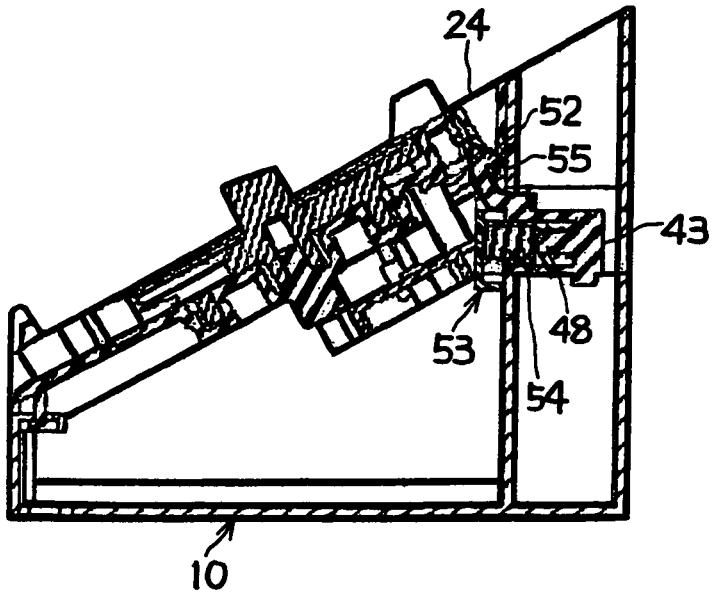
FIG. 9 is a side sectional view of the dispenser of FIG. 5, showing the latch mechanism between the deck and base latched.

In some applications it may advantageous to use a base 10 that is constructed to fit in the particular envelope provided by a host device within which the dispenser is used. In an alternate embodiment, the dispenser mechanism may be removably mounted on an intermediate deck element 24, as best shown in FIGS. 8 and 9. A latch 48 may be provided to retain deck 24 on base 10. Latch 48 may be operated by a push button release 43 and, as shown, is spring biased in a latched position. In this construction the dispenser mechanism may be manufactured generically for use with multiple bases of different configurations by standardizing deck 24.

As shown, the concept of utilizing a variety of unique rotors remains unchanged. With the exception of the rotor dials, however, the rest of the mechanism, for example deck 24, is of a common physical construction for all applications, there are no alternate assembly locations or interchangeable sets of components as in the prior art. This is accomplished by providing one adjustment to vary the position of the active components. Guide elements 2, exit roller 5 and a counting sensor may be adjusted as a unit toward a fixed hard point 7 to define the end of the annular path 11 and coin exit area 6. The position of the active components may be set using a predetermined standard gage tool, by referring to calibration markings 8 or by other gauged mechanical adjustments that indicate the relative position of the fixed base to the guide element module 20. The dispenser maybe even more standardized with the removable deck embodiment shown in FIGS. 8 and 9.

Figure 5:
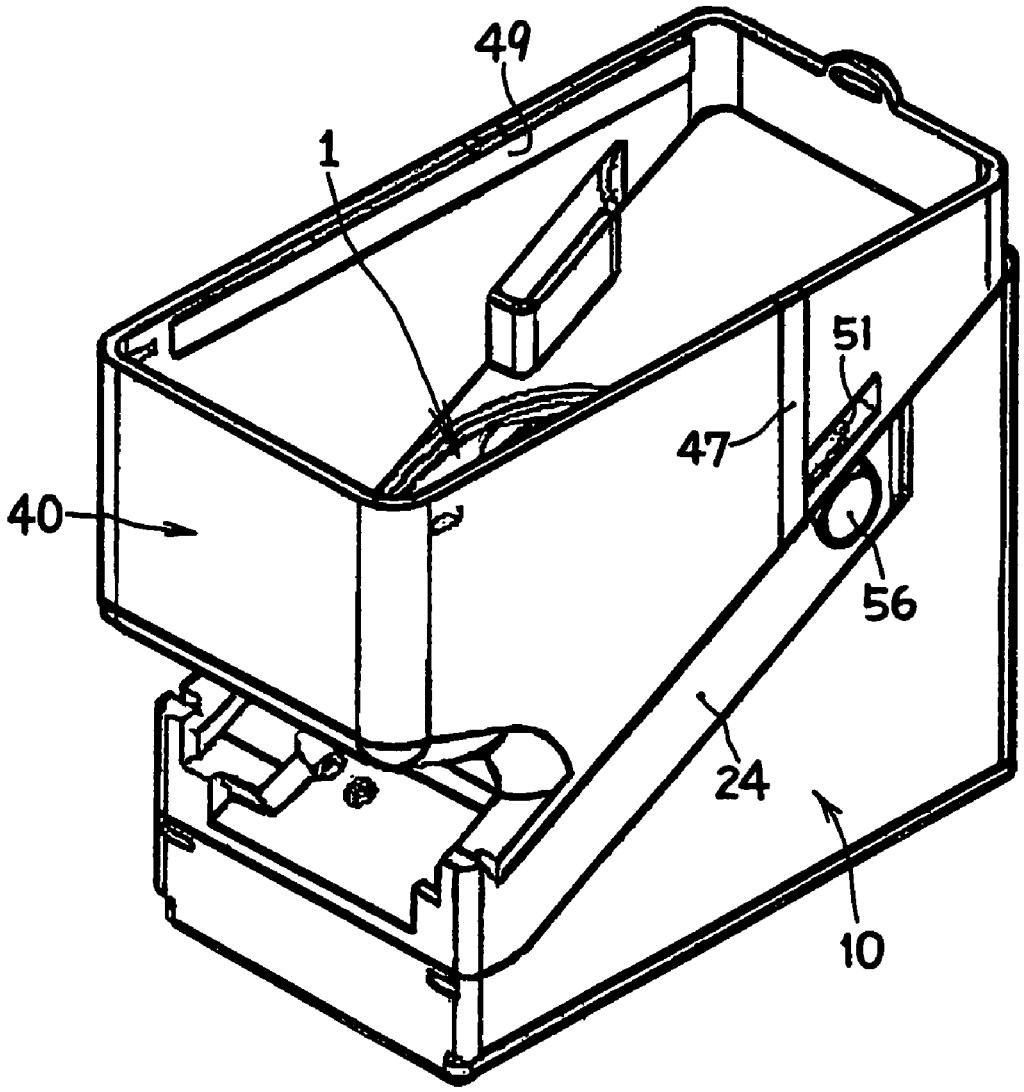
FIG. 5 is a perspective view of the assembled coin dispenser device.
Figure 6:
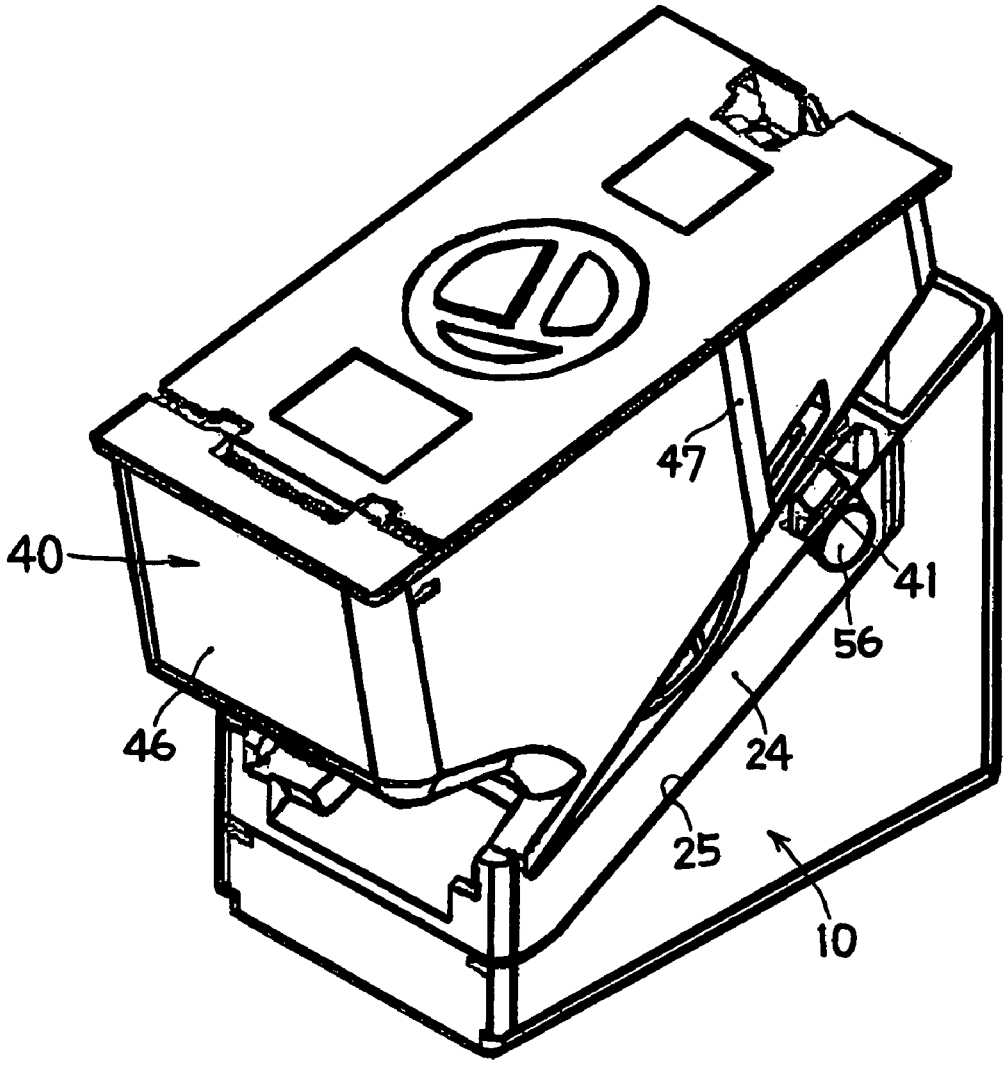
FIG. 6 is a perspective view of the coin dispenser of FIG. 5, with the bin partially unlatched.
Figure 7:
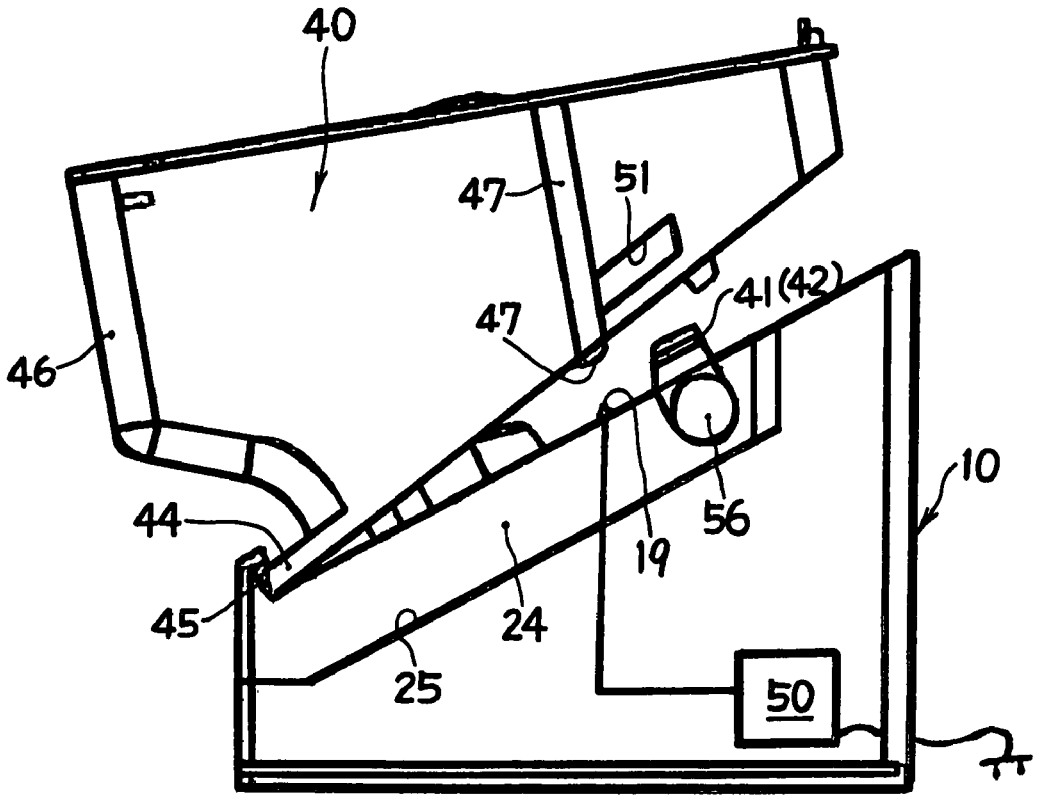
FIG. 7 is a side view of the coin dispenser of FIG. 5, with the bin partially unlatched.

In the alternative embodiment, the dispensing mechanism 100 including all of the operating elements, i.e. rotor 1, guide elements 2, 5, a drive, power supply circuitry and other supporting components may be self contained in deck 24. Base 10 may constructed with a support surface 25 that is arranged at an angle, as shown in FIG. 7, to promote coin movement from the bin 40 and along annular path 11. The dispensing mechanism 100 of deck 24 is mounted on supporting surface 25 of base 10. The coin dispenser assembly including base 10, deck 24 and bin 40 is shown in FIGS. 5-7. Bin 40 is constructed to hold a supply of coins which are allowed to fall with gravity through an exit opening in the bottom of bin 40 aligned with rotor 1.

In one embodiment of the invention, as shown FIGS. 6-8, bin 40 is assembled and held in place on deck 24 by means of releasable spring latches 41 and 42 mounted on base 10. Second structural features or latches 41 and 42 may be spring actuated, as shown in FIG. 6, to engage first structural structures on either side of bin 40, such as notches 51. Latches 41 and 42 may be constructed similarly to latch 48 shown in FIGS. 7 and 8. Latch 48 consists of a bracket 53 on which is mounted hook 52 and spring 54. As shown in FIGS. 8 and 9, the latches 41, 42 and 48 are biased into the latched position. A button 43, that forms part of latches, is constructed to allow a user to actuate the latch to release the bin 40 from deck 24 and deck 24 from the base 10, i.e. to remove hook 52 from notch 55.

To facilitate the removal of bin 40 from base 10, as shown in FIG. 7, bin 40 may be constructed with a first structural feature or a lip 44 extending outward to engage a second structural feature or a matching groove 45 which is provided on base 10. Engagement of lip 44 in groove 45 holds front end 46 of bin 40 in place, while latches 41 and 42 hold the sides of bin 40 in place. Bin 40 may be easily removed by pressing buttons 56 and pivoting the bin upwards to release lip 44 from groove 45. Deck 24 may be conveniently removed by releasing latch 48.

To monitor coin levels and the proper assembly of bin 40 on deck 24, an electrical connection is provided through a blind contact 19 on deck 24. The contact 19 may be a spring loaded pin or other appropriate contact mechanism. Contact 19 engages a conductive ribbon or a monitoring circuit 47 mounted on the bottom and the sides of bin 40 aligned with contact 19. Monitoring circuit 47 extends around bin 40 at its bottom. Interior conductive ribbon s or monitoring circuit 49 are arranged on interior top side portions 49, as shown in FIG. 5. Full coin conditions may be sensed by interior conductive ribbons 49 that form part of a monitoring circuit with ribbon 47 and contact 19. The monitoring circuit obtains energization through power supply 50. A pair of conductive posts 60 and 61, as shown in FIGS. 2 and 3, project into the bottom opening of bin 40 and form part of the monitoring circuit. Conductive posts 60 and 61 are in contact with the coin supply at its lowest point and therefore are able to sense a low coin level. Continuity in the monitoring circuit is provided when the coins are in contact with the conductive ribbons, thereby providing both empty and full indications.

In this manner a dispenser mechanism is constructed taking advantage of the reliable and robust features of prior art dispensers, while eliminating the need to assemble different bases for each denomination of coin or for every different sized disc shaped object.

It should be understood that the above description is only illustrative of the invention. Various alternatives and modifications can be devised by those skilled in the art without departing from the invention. Accordingly, the present invention is intended to embrace all such alternatives, modifications and variances which fall with the scope of the appended claims.

I claim:

1. An apparatus for dispensing disc shaped objects, the apparatus comprising:

a base having a deck;

a rotor removably mounted on the deck for rotation about an axis, said rotor having openings therein to receive the disc shaped objects, wherein the disc shaped objects may be moved with said rotor in an annular path;

a guide module having a guide element mounted thereon, said guide element extending into the annular path to dislodge the disc shaped objects from the rotor and urge said objects from the annular path towards an exit of the dispenser, said guide module mounted on the deck for movement; and wherein the position of the guide module in the annular path is adjustable to accommodate differently sized disc shaped objects by moving the guide module relative to the deck to different positions corresponding to the differently sized disc shaped objects and then locking the guide module to the deck, wherein the guide module comprises a sector shaped module mounted on the base for rotation about the axis of the rotor.

2. The apparatus according to claim 1, wherein the guide element comprises multiple elements mounted on the guide module each in a position for engaging the disc shaped objects as said objects move in the annular path.

3. The apparatus according to claim 2, wherein one of the guide elements is a roller.

4. The apparatus according to claim 2, wherein one of the guide elements is a pin.

5. The apparatus according to claim 2, wherein one of the guide elements is a sensor configured to sense the disc shaped objects as they are moved to the exit of the dispenser.

6. The apparatus according to claim 1, wherein the deck is removable from the base.

7. The apparatus according to claim 1, wherein the openings in the rotor are constructed having dimensions consistent with a particular size disc shaped object and said rotors are replaceable to accommodate disc shaped objects having different dimensions.

8. The apparatus according to claim 1, wherein the guide module is adjusted according to reference points constructed on the deck, said reference points being indicative of different size disc shaped objects.

9. The apparatus according to claim 1, wherein the guide module is adjusted according to a gauge or fixture that is indicative of different size disc shaped objects.

10. The apparatus according to claim 1, further comprising a bin constructed and arranged to store a supply of disc shaped objects, said bin being mounted on the deck and being constructed with an opening aligned with the rotor to allow disc shaped objects to move from the bin to the rotor.

11. The apparatus according to claim 10, wherein the bin further comprises:

a first structural feature constructed in the bin;

a second structural feature constructed in the deck;

wherein said first and second structural features are engageable to partially capture the bin on the deck in alignment with the rotor.

12. The apparatus according to claim 10, wherein the bin is releasably held captured on the deck by a latch.

13. The apparatus according to claim 10, wherein the bin is in electrical connection with the deck by means of aligned mating contacts mounted on the deck and bin.

14. The apparatus according to claim 13, wherein an electrical circuit is constructed in the bin which is dependent on the presence of metal disc shaped objects for continuity to monitor the supply of metal disc shaped objects.

15. The apparatus according to claim 14, wherein said electrical circuit is constructed of conductive ribbons mounted in the bin for contact with the metal disc shaped objects.

16. The apparatus according to claim 15, wherein the conductive ribbons are positioned on the bin to indicate the level of supply of metal disc shaped objects.

17. A method of adjusting guide elements in a device for dispensing disc shaped objects, wherein said device includes a rotor mounted to receive said disc shaped objects and is configured to move said objects in an annular path and wherein said guide elements are positioned in said annular path to guide said objects from the annular path to an exit of the device, the method comprising:

mounting the guide elements on a guide module, said guide module being movable on the device to adjust the position of the guide elements to accommodate differently sized disc shaped objects, the guide module comprising a sector shaped module mounted on a base of the device for rotation about an axis of the rotor;

mounting a rotor on the device constructed to receive disc shaped objects of a particular size; and adjusting the position of the guide elements by moving the guide module relative to the device to accommodate said particularly sized disc shaped objects and locking said guide module on the device.

18. The method according to claim 17, wherein the guide module is adjusted with reference to indications constructed on the device.

19. The method according to claim 17, wherein the guide module is adjusted with reference to a gauge or fixture.

20. The method according to claim 17, wherein a rotor of a first size may be exchanged for a rotor of a second size, and the guide module may be accessed for adjustment by a tool-free disassembly of the device.

* * * * *